United States Patent [19]

Nozaki et al.

[11] Patent Number: 4,768,341

[45] Date of Patent: Sep. 6, 1988

[54] TEMPERATURE CONTROL SYSTEM FOR STIRLING ENGINE

[75] Inventors: Toshihiro Nozaki, Toukai; Shigenori Haramura, Toyoake, both of Japan

[73] Assignee: Aisin Seiki Kabushiki Kaisha, Kariya, Japan

[21] Appl. No.: 679,451

[22] Filed: Dec. 7, 1984

[30] Foreign Application Priority Data

Dec. 7, 1983 [JP] Japan ..... 58-231126

[51] Int. Cl.[4] ..... F02G 1/06

[52] U.S. Cl. ..... 60/524

[58] Field of Search ..... 60/517, 523, 524

[56] References Cited

U.S. PATENT DOCUMENTS

| | | | |
|---|---|---|---|
| 2,894,368 | 7/1959 | Van Heeckeren | 60/524 |
| 3,859,794 | 1/1975 | Hakansson | 60/524 |
| 3,956,892 | 5/1976 | Nystrom | 60/524 |

*Primary Examiner*—Stephen F. Husar

*Attorney, Agent, or Firm*—Burns, Doane, Swecker & Mathis

[57] ABSTRACT

A temperature controller for controlling the tube wall temperature of a heater for absorbing heat during Stirling engine operation includes an operator circuit setting a pre-set temperature based on the pressure of the high pressure working medium. Such preset temperature is transmitted to an air-fuel rate controller for controlling the temperature at the heater to keep an optimal working condition of the engine.

2 Claims, 3 Drawing Sheets

TEMPERATURE CONTROL SYSTEM FOR STIRLING ENGINE

BACKGROUND OF THE INVENTION

1. Field of the Invention

This invention generally relates to a Stirling engine, and more particularly, to a temperature control system for the Stirling engine.

2. Description of the Prior Art

A conventional Stirling engine system is shown in FIG. 1, wherein a high temperature expansion space 1, formed by an expansion cylinder 9 and an expansion piston 10, and a constant temperature compression space 2, formed by a compression cylinder 11 and a compression piston 12, are connected to each other through a heater 3, a heat regenerator 4 and a heat radiator (or cooler) 5. A working medium used here may be either hydrogen gas or helium gas which is fluid-tightly sealed into each device. The heater 3 for absorbing heat is located within a combustion chamber 6 in which the working medium is heated and the heat radiator 5 contacts the controlling fluid such as water from a pump 7 thus by such heat exchanging, the high pressure working medium discharges heat generated by the compression operation. The heat taken by the water is then discharged to the exterior through a radiator 8. The force or energy generated within the expansion and compression spaces due to the expansion and compression operation of the high pressure gas therein may be taken from the reciprocating movement of the pistons in cooperation with piston rods 13 and 14 and a crank shaft 15 connected thereto.

The temperature at the walls of the tubes of the heater 3 is sensed by a sensor 16 made of a thermoelectric couple, and transmitted to a heat controller 17. The heat controller 17 compares the temperature difference between the actual temperature at the tubes of the heater 3 and a predetermined constant temperature $T_1$ and gives a PID operation to the obtained difference. PID means proportioning, integration and differentiation. In other words, in order to eliminate the difference in temperature, an opening degree of an air flow regulating valve 18 is changed to control the air flow amount so that air for combustion may be in turn controlled. The air is supplied from a blower 20 which is operated by a belt 19 and the crank shaft 15 drive system. The controlled air is transmitted to an air-fuel rate controller 21 and the controller 21 controls also the fuel amount. Thus controlled fuel is injected into the combustion chamber 6 to be burned with the air for combustion. Numeral 23 designates gas pressure controller to control the pressure of the gas.

The predetermined temperature T may be determined by the material characteristics of the heater 3 and the gas pressure at full load condition of the engine operation. Generally, as a characteristic of the metal, there is a tendency that the more the temperature increases, the less the tension strength ($S\tau$) becomes (See FIG. 2). In addition, considering that the gas pressure becomes maximum under full load conditions, the stress applied to the heater 3 becomes maximum under such circumstances. It is, therefore, desirable to determine the temperature T depending upon the strength of the heater 3 under full load conditions. Thus, such temperature T is determined based on the engine full load condition. However, it is also desirable to determine the temperature T to give as high a power output and as high an efficiency to the engine as possible.

FIG. 3 shows the relationship between the gas pressure P and the maximum allowable temperature T for the walls of the heater 3. $T_1$ in FIG. 3 indicates a constant temperature determined only under full load conditions. As is apparent from the drawing, it is possible to set the temperature higher than $T_1$ when the gas pressure P is in low range.

Thus, determining the temperature T as a constant value $T_1$ is not an efficient nor a sufficient way especially when the gas temperature is low.

SUMMARY OF THE INVENTION

It is, therefore, an object of the present invention to provide an improved temperature control system for a Stirling engine.

It is another object of the invention to provide an improved temperature control system of the heater for a Stirling engine.

It is still a further object of the invention to obviate the above conventional drawbacks.

In order to obtain an optimal preset temperature for the heater, a temperature T′ is determined for the heater control based on the gas pressure considering also the maximum allowable temperature for the heater breakdown.

BRIEF DESCRIPTION OF THE DRAWINGS

The above and other objects and features of the present invention will become apparent from the following description with reference to the attached drawings wherein.

DETAILED DESCRIPTION OF THE PREFERRED EMBODIMENT

Figure 1:
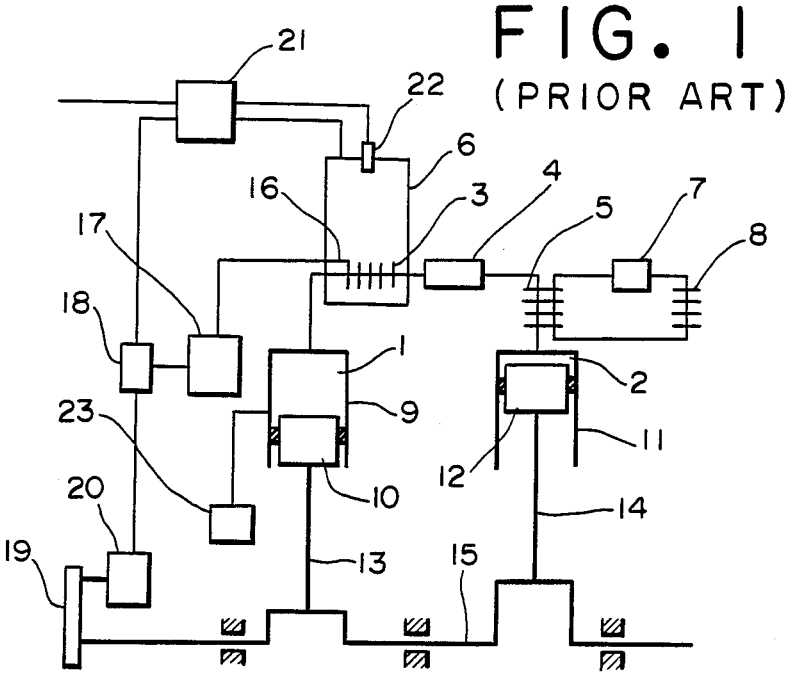
FIG. 1 (PRIOR ART)
FIG. 1 is a diagram of a conventional Stirling engine system including a conventional temperature control system for the heater.
Figure 2:
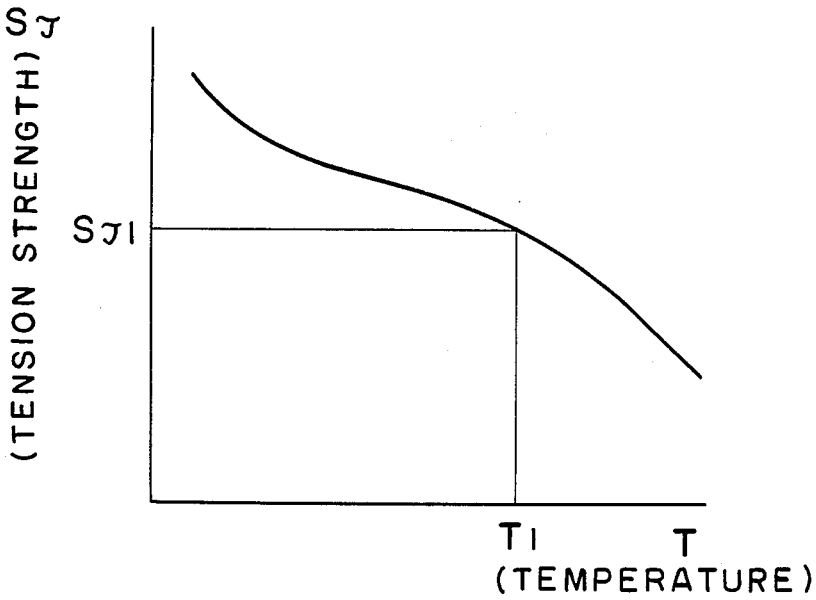
FIG. 2 is a graph indicating the relationship between the temperature and tension strength ($S\tau$) of a metal in general.
Figure 3:
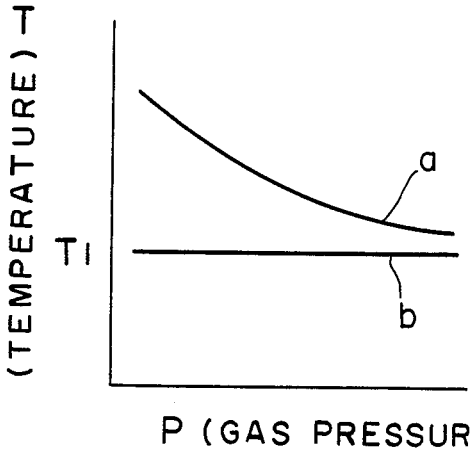
FIG. 3 is a graph showing the relationship between gas pressure (P) and the maximum allowable temperature for heater breakdown.
Figure 4:
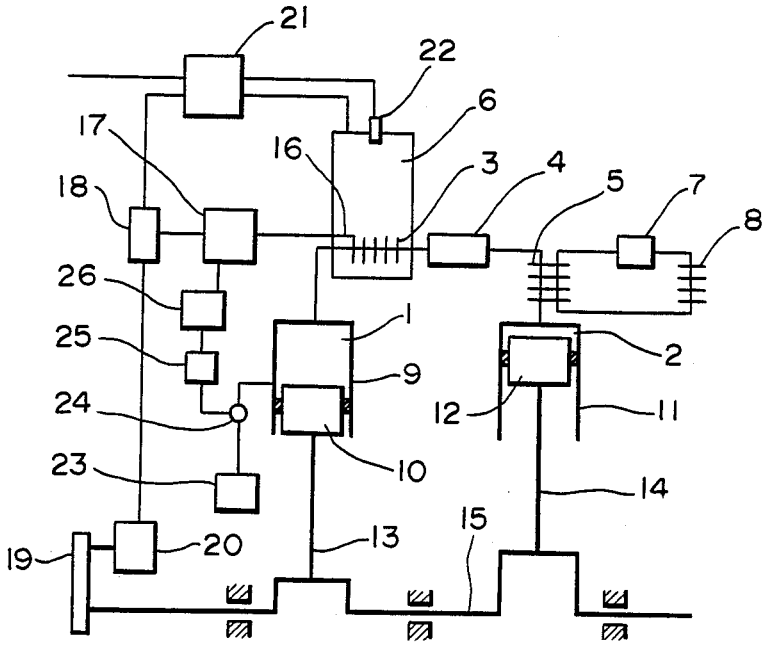
FIG. 4 is a diagram of an embodiment of the present invention.

Referring now to the drawings, particularly to FIG. 4, corresponding parts in FIG. 1 have the same reference numerals here in order to be easily understood. A pressure sensor 24, a converter 25 and an operator circuit 26 are newly added.

The pressure of the working medium such as helium gas is sensed by the sensor 24, and such sensed pressure is converted to a signal by the converter 25. The operator circuit 26 receives such signal, and according to the signal, the circuit 26 sets a predetermined temperature T′ for the heater 3.

Figure 5:
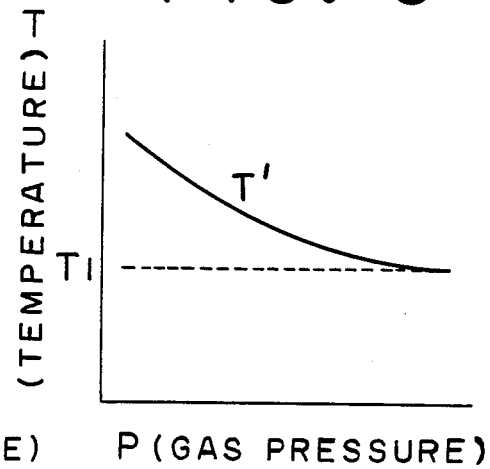
FIG. 5 is a graph showing a characteristic relationship between the gas pressure (P) and the predetermined temperature (T′) according to the invention.

FIG. 5 shows the relationship between the temperature T′ and the gas pressure P, which has been determined by the relation between the gas pressure and the maximum allowable temperature for the heater breakdown.

According to the invention, it becomes possible to set the temperature of the heater relatively high, even under partial load conditions. The Stirling engine is mostly applied to the industrial field such as industrial machines, electric power machines and transportation machines, wherein partial or regular load conditions are mostly used.

Figure 6:
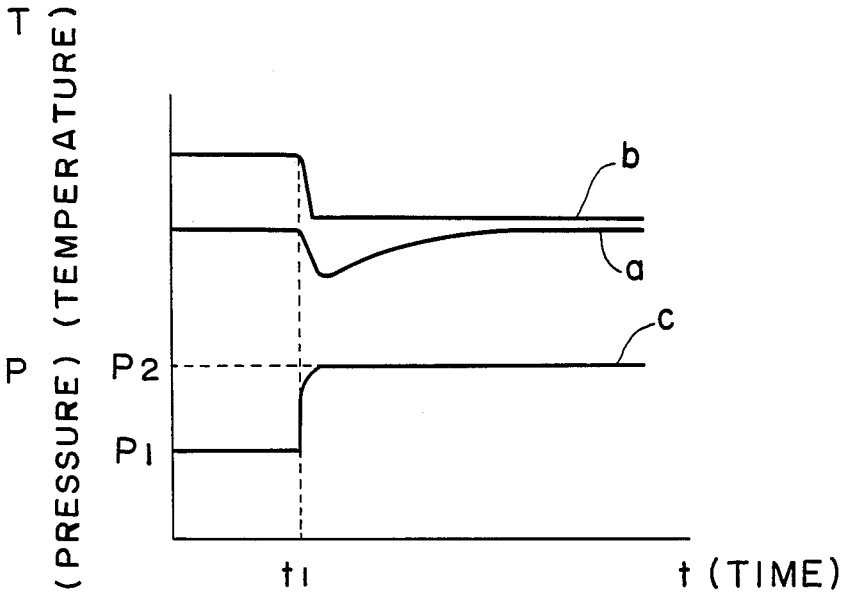
FIG. 6 is a graph showing the temperature (T) change at the heater tube when the gas pressure (P) increases.

In FIG. 6, when the gas pressure P is increased from $P_1$ to $P_2$ for the time period "$t_1$"($P_1 < P_2$), as shown at line "c", the temperature of the heater 3 changes along the line "a" according to the conventional system, whereas it changes along the line "b" according to the invention. According to the former system, the heater temperature goes down which will result in a bad response during the pressure increase operation.

Although the invention is described with reference to a particular embodiment thereof, it is to be understood that the invention is not limited to the disclosed embodiment but is capable of various other embodiments within the scope of the appended claims.

What is claimed is:

1. A temperature control system for a Stirling cycle engine, comprising:

an expansion space having a relatively high mean temperature during operation;

a compression space having a relatively low mean temperature during operation;

a heater, a regenerator and a heat radiator disposed between said spaces in series, the heater having at least one tube; and a temperature controller for controlling the tube wall temperature of said heater, said temperature controller including:

an operator device setting a predetermined temperature for said heater based on the working gas pressure, whereby said tube wall temperature of said heater is controlled to said predetermined temperature;

a pressure sensor for sensing the pressure of a working gas during operation and sending a signal to said operator device for deciding said predetermined temperature;

wherein said pressure sensor is connected to the expansion space and is disposed at a connecting portion between the expansion space and a gas pressure controller for controlling the gas pressure in the expansion space.

2. A temperature control system according to claim 1, wherein said temperature controller further includes an air-fuel rate controller for controlling the temperature of the wall of said heater to be kept at said predetermined temperature.

* * * * *